US008371295B2

(12) United States Patent
Turiello

(10) Patent No.: US 8,371,295 B2
(45) Date of Patent: Feb. 12, 2013

(54) BREATHABLE AIR SAFETY SYSTEM FOR BOTH EMERGENCY AND CIVILIAN PERSONNEL

(75) Inventor: Anthony J. Turiello, Portola Valley, CA (US)

(73) Assignee: Rescue Air Systems, Inc., San Carlos, CA (US)

( * ) Notice: Subject to any disclaimer, the term of this patent is extended or adjusted under 35 U.S.C. 154(b) by 995 days.

(21) Appl. No.: 12/177,891

(22) Filed: Jul. 23, 2008

(65) Prior Publication Data

US 2010/0031955 A1 Feb. 11, 2010

(51) Int. Cl.
*A62B 7/00* (2006.01)

(52) U.S. Cl. ..... 128/202.13; 128/205.15

(58) Field of Classification Search ..... 141/2, 4, 141/18, 54, 94–95, 197, 236, 237, 99, 47, 141/234; 128/200.24, 205.25, 202.13, 205.14, 128/205.26, 204.18, 202.17, 205.28, 200.25, 128/205.24, 202.25; 454/338, 342, 370
See application file for complete search history.

(56) References Cited

U.S. PATENT DOCUMENTS 3,973,562 A * 8/1976 Jansson ..... 128/205.12
4,076,041 A * 2/1978 Christianson ..... 137/490
4,134,457 A * 1/1979 O'Reilly ..... 169/16
4,165,738 A * 8/1979 Graves et al. ..... 128/202.13
4,331,139 A * 5/1982 Popa ..... 128/202.13
4,373,522 A * 2/1983 Zien ..... 128/206.12
4,380,187 A * 4/1983 Wicks ..... 454/342
4,467,796 A * 8/1984 Beagley ..... 128/202.13
4,608,975 A * 9/1986 Tannatta ..... 128/202.13
4,640,278 A * 2/1987 Barry ..... 128/206.12
4,774,939 A * 10/1988 Disney ..... 128/200.24
4,862,931 A * 9/1989 Vella ..... 141/1
4,905,684 A * 3/1990 Heffer ..... 128/202.13
5,163,422 A * 11/1992 Burgess ..... 128/200.24
5,396,885 A * 3/1995 Nelson ..... 128/204.18
5,513,678 A * 5/1996 Schultz et al. ..... 141/4
5,517,982 A * 5/1996 Grivas ..... 128/200.24
5,570,685 A * 11/1996 Turiello ..... 128/202.13
5,730,121 A * 3/1998 Hawkins et al. ..... 128/205.25
5,809,999 A * 9/1998 Lang ..... 128/200.24
6,520,178 B1 * 2/2003 Baker ..... 128/202.27
6,832,952 B2 * 12/2004 Faltesek et al. ..... 454/338
7,168,428 B1 * 1/2007 Zoha ..... 128/202.27
7,249,617 B2 * 7/2007 Musselman et al. ..... 141/231
7,415,995 B2 * 8/2008 Plummer et al. ..... 141/197
7,530,403 B2 * 5/2009 Cano ..... 169/24
7,770,610 B2 * 8/2010 Lisle ..... 141/54
2002/0185283 A1 * 12/2002 Taylor ..... 169/43
2003/0010343 A1 * 1/2003 York ..... 128/205.22
2006/0131038 A1 * 6/2006 Lichtig ..... 169/52

(Continued)

*Primary Examiner* — Loan Thanh
*Assistant Examiner* — Sundhara Ganesan
(74) *Attorney, Agent, or Firm* — Raj Abhyanker, P.C

(57) ABSTRACT

A method and/or system for a breathable air safety system for both emergency and civilian personnel are disclosed. In one embodiment, a safety system includes a supply unit of a structure to facilitate delivery of a breathable air from a source of compressed air to an air distribution system of the structure, a civilian air supply enclosure of the structure to provide a civilian pressure of the breathable air such that the civilian pressure is suitable for direct human consumption through a civilian breathable air apparatus coupled with the civilian air supply enclosure, a firefighter air supply enclosure of the structure to provide a high-pressure of the breathable air such that the high-pressure is suitable to fill the breathable air in a firefighter breathable air apparatus through a RIC/UAC connector of the fill panel and/or a CGA connector.

20 Claims, 14 Drawing Sheets

U.S. PATENT DOCUMENTS

2007/0034283 A1* 2/2007 Plummer et al. ..... 141/234
2007/0163578 A1* 7/2007 Lisle ..... 128/202.12
2007/0235030 A1* 10/2007 Teetzel et al. ..... 128/205.12
2007/0299473 A1* 12/2007 Matos ..... 607/5
2008/0023100 A1* 1/2008 Wonders ..... 141/95
2009/0133697 A1* 5/2009 Kwok et al. ..... 128/205.25
2009/0314296 A1* 12/2009 Cannon ..... 128/205.25
2010/0065056 A1* 3/2010 Greter ..... 128/204.23

* cited by examiner

BREATHABLE AIR SAFETY SYSTEM FOR BOTH EMERGENCY AND CIVILIAN PERSONNEL

FIELD OF TECHNOLOGY

This disclosure relates generally to the technical fields of safety systems and, in one example embodiment, to a method and/or system for a breathable air safety system for both emergency and civilian personnel.

BACKGROUND

A person (e.g., a civilian, a firefighter, etc.) may be unable to escape out of a structure (e.g., a skyscraper, a building, etc.) when an emergency situation occurs. The person may not be able to evacuate because he or she may be injured in an enclosed region (e.g., a room, an elevator, a stairwell, etc.) of the structure. In some instances, the person may be trapped on a floor above one in which there is a fire and/or chemical attack. The person may not be able to breathe because a breathable air inside the structure may be unusable (e.g., depleted, contaminated, etc.).

In addition, sometimes a task of locating the person trapped in the structure can be difficult because of hazards of the structure (e.g., structural problems, broken stairwells, high temperatures, etc.). The person may not be able to communicate his or her position in the structure (e.g., may not be able to accurately describe where he or she is over a phone, may not have access to the phone, may not have a light/flare, etc.). It may take time for emergency personnel (e.g., a firefighter, a police officer, a security guard, etc.) to reach the person. As a result, the person may suffocate in the structure because it may take too long for the emergency personnel to reach the person.

When the person is one of the emergency personnel deployed on site of the structure, lack of breathable air deteriorates the person's ability to alleviate the emergency situation and to rescue another person (e.g., a civilian, an injured firefighter, etc.) from the structure. Sometimes, the person may die from the lack of breathable air. Consequently, a survival rate of the other person waiting to be rescued may substantially decrease.

SUMMARY

A method and/or system for a breathable air safety system for both emergency and civilian personnel are disclosed. In one aspect, a safety system (e.g., emergency systems, etc.) includes a supply unit of a structure to facilitate delivery of a breathable air from a source of compressed air to an air distribution system of the structure, a civilian air supply enclosure of the structure to provide a civilian pressure of the breathable air such that the civilian pressure is suitable for direct human consumption through a civilian breathable air apparatus coupled with the civilian air supply enclosure, a firefighter air supply enclosure of the structure to provide a high-pressure of the breathable air such that the high-pressure is suitable to fill the breathable air in a firefighter breathable air apparatus through a RIC/UAC connector and/or a CGA (Compressed Gas Association) connector of the firefighter air supply enclosure, and a routing mechanism of the structure to provide a distribution of the breathable air through at least one of a wall, a ceiling, and a floorrouting between the fill panel and other fill panels of a particular floor through interior walls of a floor of the structure.

The safety system may include a combined fill panel of the structure that provides the breathable air at the civilian pressure suitable for direct human consumption concurrently with the breathable air at the high-pressure suitable for filling the breathable air in the firefighter breathable air apparatus. The civilian pressure of the breathable air provided by the civilian air supply enclosure may be approximately 10 to 40 Pounds per Square Inch (PSI). The high-pressure of the breathable air provided by the firefighter air supply enclosure may be approximately 3000-6000 Pounds per Square Inch (PSI). The civilian breathable air apparatus may be a respiratory mask, a face covering, and/or a protective breathing unit. The firefighter breathable air apparatus may be a portable compressed air container that facilitates delivery of the breathable air to the firefighter during a rescue mission.

A breakable cover of an enclosure of the civilian air supply enclosure may secure the civilian air supply enclosure from intrusions that potentially compromise safety and/or reliability of the air distribution system. A solid cover with a locking mechanism of the firefighter air supply enclosure may secure the firefighter air supply enclosure from intrusions that potentially compromise safety and reliability of the air distribution system. The civilian air supply enclosure may include a communication system of the civilian air supply enclosure to enable communication with emergency personnel directly from the civilian air supply enclosure.

An alarm may be triggered when the breakable cover of the civilian air supply enclosure may be compromised that alerts an emergency personnel to a location in the structure where rescue aid may be required. The safety system may include an enclosure encompassing the civilian air supply enclosure and/or the firefighter air supply enclosure may have a weather resistant feature, ultraviolet and/or infrared solar radiation resistant feature to prevent corrosion and/or physical damage. The safety system may also include a valve to prevent leakage of the breathable air from the air distribution system potentially leading to loss of a system pressure.

The system may include a regulation module of the civilian air supply enclosure and/or the firefighter air supply enclosure to maintain pressures of the breathable air when other breathable air apparatuses may be actively being used to deliver the breathable air through the fill panel. The system may include any of a fire rated material and/or a fire rated assembly to enclose a piping of the air distribution system such that the air distribution system may have the ability to withstand elevated temperatures for a prescribed period of time.

The system may include a robust solid casing to encase the piping to prevent physical damage to the air distribution system potentially compromising a safety and/or integrity of the air distribution system. Any of a stainless steel and a thermoplastic material may ensure that the piping may be compatible for use with the compressed air.

In another aspect, a method of a safety system in a structure includes transferring a breathable air from an air distribution system to a civilian air supply enclosure having a valve to regulate distribution of air to a person at a civilian pressure suitable for direct human consumption through a civilian breathable air apparatus coupled with the civilian air supply enclosure, transferring the breathable air from the air distribution system to a firefighter air supply enclosure having a valve to regulate distribution of air to a person at a high-pressure suitable for filling the breathable air in a firefighter breathable air apparatus through an RIC/UAC connector and/or a CGA connector on the firefighter air supply enclosure, detecting that a quality of the breathable air is safe to use, determining that a breakable cover of the civilian air supply enclosure is compromised, and transmitting a signal that provides a notification of a location of the civilian air supply enclosure to emergency personnel.

The civilian pressure of the breathable air provided by the civilian air supply enclosure may be approximately 10 to 40 Pounds per Square Inch (PSI). The high-pressure of the breathable air provided by the firefighter air supply enclosure may be approximately 3000-6000 Pounds per Square Inch (PSI). The civilian breathable air apparatus may be a respiratory mask, a face covering, and/or a protective breathing unit. The firefighter breathable air apparatus may be a portable compressed air container that may facilitate delivering of the breathable air to the firefighter during a rescue mission.

The method may include providing a communication mechanism between the civilian air supply enclosure and the emergency personnel through a telephone affixed to the fill panel. The method may maintain a pressure of the breathable air when breathable air apparatuses are be actively being used to deliver the breathable air through the civilian air supply enclosure and/or the firefighter air supply enclosure.

In yet another aspect, a structure includes a civilian air supply enclosure to provide a civilian-pressure of a breathable air such that a civilian pressure is suitable for direct human consumption through a civilian breathable air apparatus coupled with the civilian air supply enclosure, a firefighter air supply enclosure to provide a high-pressure of the breathable air such that pressures is suitable for filling the breathable air in a firefighter breathable air apparatus through a RIC/UAC and/or a CGA connector on the fill panel, and a regulation module to maintain a pressure of the breathable air of the civilian air supply enclosures and the firefighter air supply enclosures are actively being used to deliver the breathable air.

The regulation module may be installed the civilian air supply enclosure, the firefighter air supply enclosure, and/or an air distribution system to facilitate delivering of the breathable air of approximately 10 to 40 Pounds per Square Inch (PSI) for the civilian air supply enclosure to facilitate delivering of the breathable air of approximately 3000-6000 Pounds per Square Inch (PSI) for the firefighter air supply enclosure. The civilian pressure of the breathable air may be approximately 10 to 40 Pounds per Square Inch (PSI) for a civilian breathable air apparatus such that civilian pressure may be suitable for direct human consumption through a civilian breathable air apparatus. The civilian breathable air apparatus may be a respiratory mask, a face covering, and/or a protective breathing unit.

The high-pressure of the breathable air may be approximately 3000-6000 Pounds per Square Inch (PSI) for a firefighter breathable air apparatus such that the high-pressure is suitable for filling a compressed form of the breathable air in a firefighter breathable air apparatus through the RIC/UAC/CGA connector. The firefighter breathable air apparatus may be a portable compressed air container that facilitates delivering of the breathable air to the firefighter during a rescue mission.

The methods, systems, and apparatuses disclosed herein may be implemented in any means for achieving various aspects, and may be executed in a form of a machine-readable medium embodying a set of instructions that, when executed by a machine, cause the machine to perform any of the operations disclosed herein. Other features will be apparent from the accompanied drawings and from the detailed description that follows.

BRIEF DESCRIPTION OF THE DRAWINGS

Example embodiments are illustrated by ways of examples and not by limitation in the figures of the accompanied drawings, which represent references indicate similar elements and in which.

Figure 1:
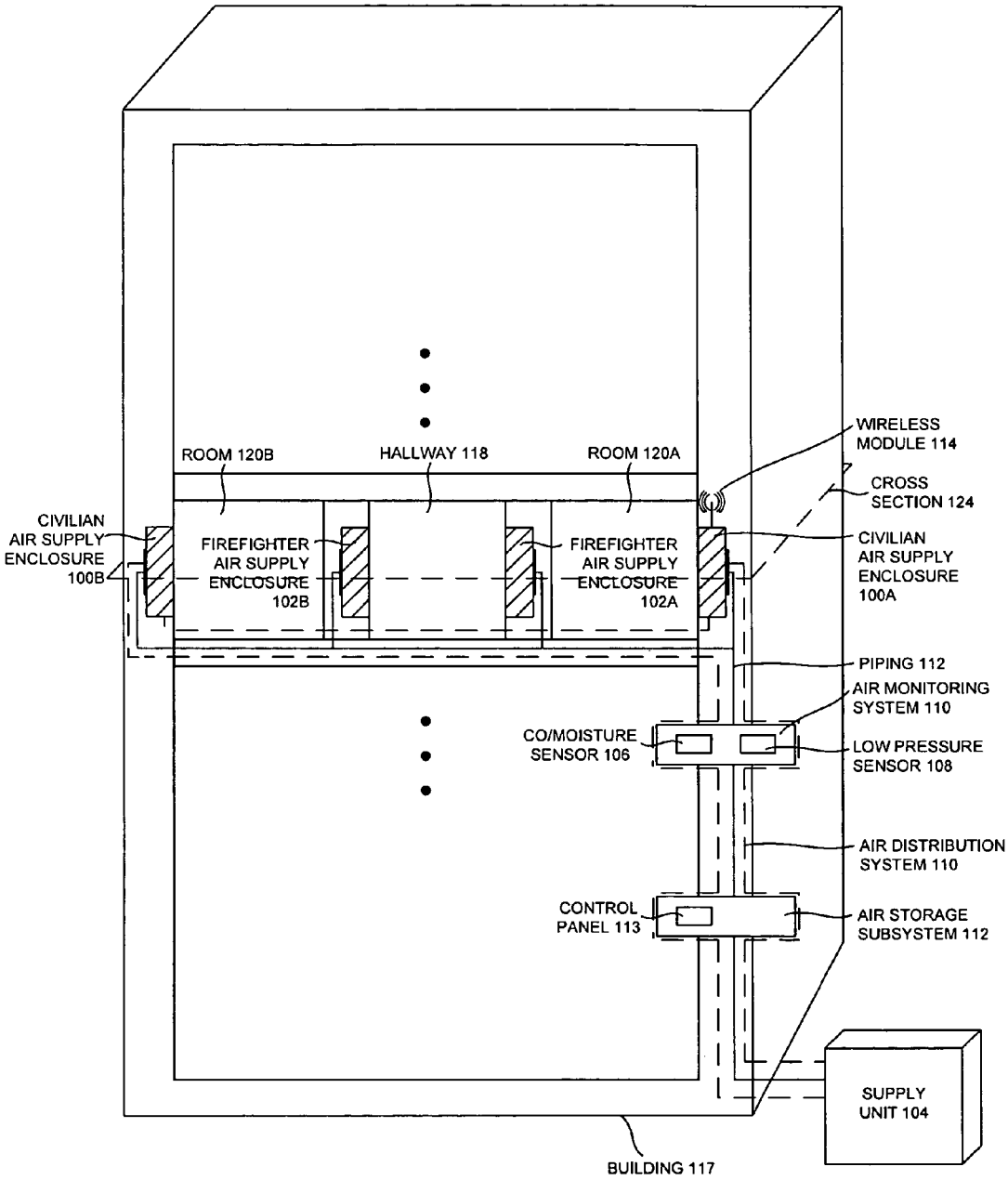
FIG. 1 is a system view of an air distribution system to provide a breathable air in a building structure through fill panel during an emergency, according to one embodiment.

Other features of the present embodiments will be apparent from the accompanying drawings and from the detailed description that follows.

DETAILED DESCRIPTION

A method and/or system for a breathable air safety system for both emergency and civilian personnel are disclosed. Although the present embodiments have been described with references to specific example embodiments, it will be evident that various modifications and changes may be made to these embodiments without departing from the broader spirit and scope of the various embodiments.

In one embodiment, a safety system includes a supply unit (e.g., the supply unit 104 of FIG. 1) of a structure (e.g., may be the building 117 of FIG. 1) to facilitate delivery of a breathable air from a source of compressed air (e.g., may be from the supply unit 104 of FIG. 1) to an air distribution system (e.g., the air distribution system 116 of FIG. 1) of the structure, a civilian air supply enclosure (e.g., the civilian air supply enclosures 100A-B of FIG. 1) of the structure to provide a civilian pressure of the breathable air such that the civilian pressure is suitable for direct human consumption through a civilian breathable air apparatus (e.g., the civilian breathable air apparatus 1308 of FIG. 13) coupled with the civilian air supply enclosures 100A-B, a firefighter air supply enclosure (e.g., the firefighter air supply enclosures 102A-B of FIG. 1) of the structure to provide a high-pressure of the breathable air such that the high-pressure is suitable to fill the breathable air in a firefighter breathable air apparatus through a RIC/UAC connector and/or CGA connector of the firefighter air supply enclosure, and a routing mechanism of the structure to provide a distribution of the breathable air through at least one of a wall, a ceiling, and a floorrouting between the fill panel and other fill panels of a particular floor through interior walls of a floor of the structure.

In another embodiment, a method of a safety system in a structure includes transferring a breathable air from an air distribution system (e.g., the air distribution system 116 of FIG. 1) to a civilian air supply enclosure (e.g., the civilian air supply enclosures 100A-B of FIG. 1) having a valve to regulate distribution of air to a person at a civilian pressure suitable for direct human consumption through a civilian breathable air apparatus (e.g., the breathable air apparatuses 306A-N of FIG. 3) coupled with the civilian air supply enclosures 100A-B, transferring the breathable air from the air distribution system 116 to a firefighter air supply enclosure (e.g., the firefighter air supply enclosures 102A-B of FIG. 1) having a valve to regulate distribution of air to a person at a high-pressure suitable for filling the breathable air in a firefighter breathable air apparatus through an RIC/UAC and/or a CGA connector on the firefighter air supply enclosures 102A-B, detecting that a quality of the breathable air is safe to use, determining that a breakable cover (e.g., the breakable cover 702 of FIG. 7) of the civilian air supply enclosures 100A-B is compromised, and transmitting a signal that provides a notification of a location of the civilian air supply enclosures 100A-B to emergency personnel.

In yet another embodiment, a structure includes a civilian air supply enclosure (e.g., the civilian air supply enclosures 100A-B of FIG. 1) to provide a civilian-pressure of a breathable air such that a civilian pressure is suitable for direct human consumption through a civilian breathable air apparatus (e.g., the breathable air apparatuses 306A-N of FIG. 3) coupled with the civilian air supply enclosure 100A-B, a firefighter air supply enclosure (e.g., the firefighter air supply enclosures 102A-B of FIG. 1) to provide a high-pressure of the breathable air such that pressures is suitable for filling the breathable air in a firefighter breathable air apparatus through an RIC/UAC and/or a CGA connector on the fill panel, and a regulation module (e.g., the regulation module 322 of FIG. 3) to maintain a pressure of the breathable air of the civilian air supply enclosures 100A-B and the firefighter air supply enclosures 102A-B are actively being used to deliver the breathable air.

FIG. 1 is a system view of an air distribution system to provide a breathable air in a building structure through fill panel during an emergency, according to one embodiment. Particularly, FIG. 1 illustrates civilian air supply enclosures 100A-B, firefighter air supply enclosures 102A-B, a supply unit 104, a CO/moisture sensor 106, a low pressure sensor 108, an air monitoring system 110, an air storage subsystem 112, a control panel 113, a wireless module 114, an air distribution system 116, hallway 118, rooms 120A-B, a cross section 122, and piping 124, according to one embodiment.

The civilian air supply enclosures 100A-B placed at several locations may facilitate civilians with breathable air during emergency. The firefighter air supply enclosures 102A-B placed at several locations may facilitate firefighters with breathable air during emergency operations. The supply unit 104 may facilitate delivery of breathable air (e.g., that may be stored in supply unit 104) from the source of compressed air to the air distribution system 116.

The CO/moisture sensor 106 may be used to measure the carbon monoxide/moisture content in the breathing air and/or medical air supplies and/or may provide a signal for an alarm when safety levels are exceeded. The low pressure sensor 108 may be used to monitor pressure levels of the breathable air in the air distribution system 150 such that the pressure level may not drop below a threshold pressure level.

The air monitoring system 110 may contain multiple sensors such as the CO/moisture sensor 106, the low pressure sensor 108, etc. to track quality of the breathable air in the air distribution system 116. The air storage subsystem 112 may store and supply the breathable air coming from the supply unit. The control panel 113 may have a collection of switches and measurement indicators that may be required to monitor and/or control the safety system. The wireless module 114 may communicate with remote entities (e.g., a supply unit 104, a building administration 1002 of FIG. 10, and/or an emergency agency 1004 of FIG. 10, etc.) during emergency or during any contamination in breathable air.

The air distribution system 116 may be a system that may distribute breathable air through out the building during emergency situations. The hallway 118 may be an elongated open space for navigating in a building. The rooms 120A-B may be a place of operation (e.g., business, residential, etc.). The cross section 122 may be plane where the cross sectional study of the building may be made. The piping 124 may be guided navigation for the breathable air from supply unit to the fill panels.

In example embodiment, FIG. 1 may illustrate a safety system in the building which may include the supply unit 104 that may distribute the breathable air from the air storage subsystem 112. The control panel 113 may control the air distribution system 116 by monitoring the measured data from the sensor devices (e.g., the CO/moisture sensor 106, the low pressure sensor 108, etc.). The control panel 113 may communicate the information to remote devices through the wireless module 114.

In one embodiment, the supply unit 104 of a structure may facilitate delivery of a breathable air from a source of compressed air to the air distribution system 116 of the structure. The civilian air supply enclosures 100A-B of the structure may provide a civilian pressure of the breathable air such that the civilian pressure may be suitable for direct human consumption through a civilian breathable air apparatus (e.g., the breathable apparatus 306A-N of FIG. 3) coupled with the civilian air supply enclosures 100A-B. The firefighter air supply enclosures 102A-B of the structure may provide a high-pressure of the breathable air such that the high-pressure may be suitable to fill the breathable air in a firefighter breathable air apparatus through a RIC/UAC/CGA connectors 1320 of the fill panel (e.g., the civilian air supply enclosure, the firefighter air supply enclosure, etc.).

A routing mechanism of the structure may provide a distribution of the breathable air through at least one of a wall, a ceiling, and a floorrouting between the fill panel and other fill panels of a particular floor through interior walls of a floor of the structure. The civilian pressure of the breathable air provided by the civilian air supply enclosures 100A-B may be approximately 10 to 40 Pounds per Square Inch (PSI). The high-pressure of the breathable air provided by the firefighter air supply enclosures 102A-B may be approximately 3000-6000 Pounds per Square Inch (PSI). A valve may prevent leakage of the breathable air from the air distribution system 116 potentially leading to loss of a system pressure (e.g., the system pressure 6500 PSI of FIG. 4).

A fire rated material and/or a fire rated assembly may enclose the piping 124 of the air distribution system 116 such that the air distribution system 116 has the ability to withstand elevated temperatures for a prescribed period of time. A robust solid casing may encase the piping to prevent physical damage to the air distribution system 116 potentially compromising a safety and/or integrity of the air distribution system 116. Any of a stainless steel and/or a thermoplastic material may ensure that the piping 124 is compatible for use with the compressed air.

The breathable air may be transferred from the air distribution system 116 to the civilian air supply enclosures 100A-B having a valve to regulate distribution of air to a person at a civilian pressure suitable for direct human consumption through the breathable air apparatuses 306A-N coupled with the civilian air supply enclosures 100A-B. The breathable air may be transferred from the air distribution system 116 to the firefighter air supply enclosures 102A-B having a valve to regulate distribution of air to a person at a high-pressure suitable for filling the breathable air in the firefighter breathable air apparatus through an RIC/UAC/CGA connectors 1320 on the firefighter air supply enclosures 102A-B.

It may be detected that a quality of the breathable air may be safe to use. The pressure of the breathable air when breathable air apparatuses are be actively being used to deliver the breathable air may be maintained through the civilian air supply enclosures 100A-B and the firefighter air supply enclosures 102A-B.

Figure 2:
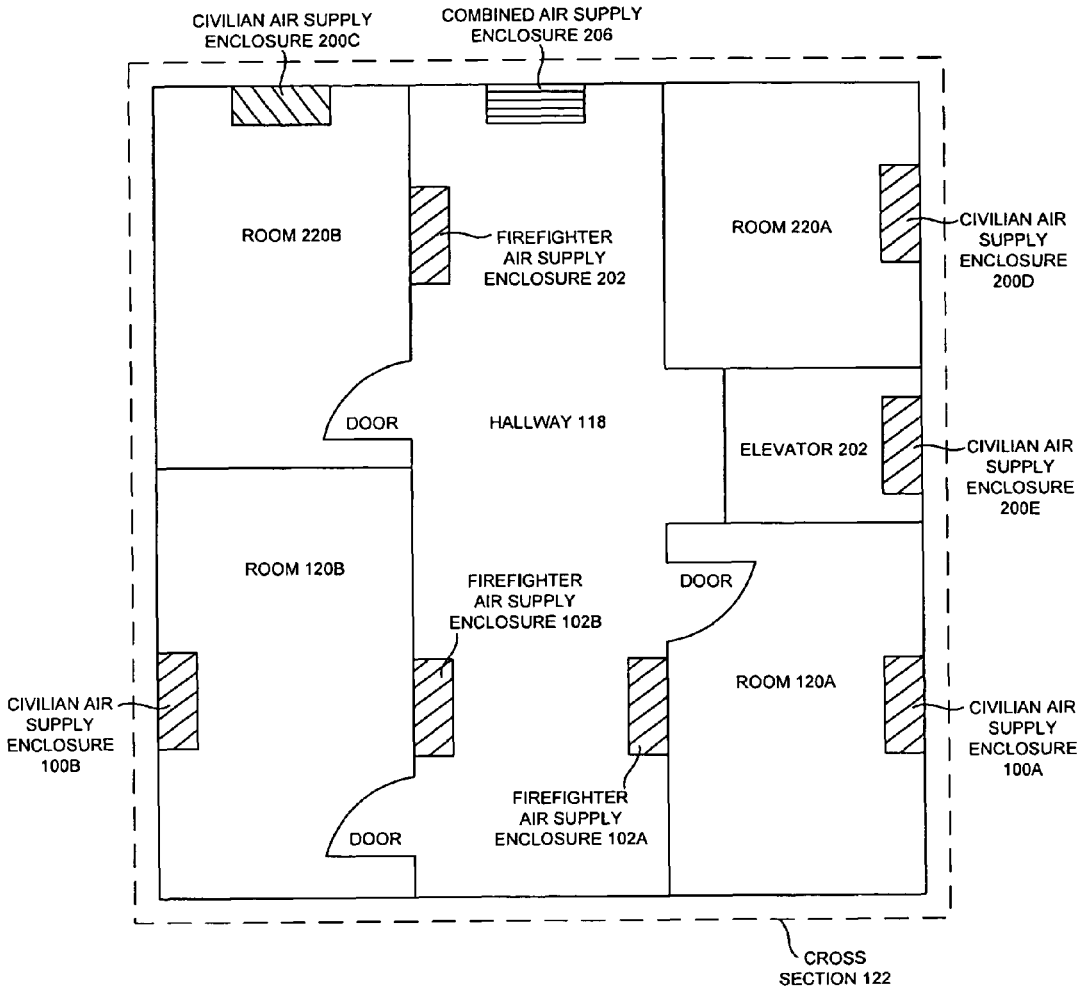
FIG. 2 is a cross sectional view of the safety system of FIG. 1, according to one embodiment.

FIG. 2 is a cross sectional view of the safety system of FIG. 1, according to one embodiment. Particularly, FIG. 2 illustrates the civilian air supply enclosures 100A-B, the firefighter air supply enclosures 102A-B, a firefighter air supply enclosure 202, the hallway 118, the rooms 120A-B, civilian air supply enclosures 200A-C, elevator 204, combined fill panel 206, and the cross section 122, according to one embodiment.

The civilian air supply enclosures 200A-C may be the fill panels that may supply the breathable air to the civilians inside the rooms. The elevator 204 may be a transport device that may be used to move goods, people, etc. vertically (e.g., may be upwards/downwards) in a building structure. The combined fill panel 206 may be a combination of fill panels and control panel.

In example embodiment, FIG. 2 illustrates the cross section 122 that may include the elevator 204, the hallway 118, the civilian air supply enclosures 100A-B, the civilian air supply enclosures 200A-E, the firefighter air supply enclosures 102A-B, the firefighter air supply enclosure 202 and the rooms 120A-B, the rooms 220A-B. The civilian air supply enclosures 100A-B and 200A-F and/or the firefighter air supply enclosures 102A-B and 202 placed at several locations in the building may facilitate the delivery of breathable air from the supply unit 104 to the air distribution system 116 during emergency.

In one embodiment, The combined fill panel 206 of the structure that may provide the breathable air at the civilian pressure suitable for direct human consumption concurrently with the breathable air at the high-pressure suitable for filling the breathable air in the firefighter breathable air apparatus.

Figure 3:
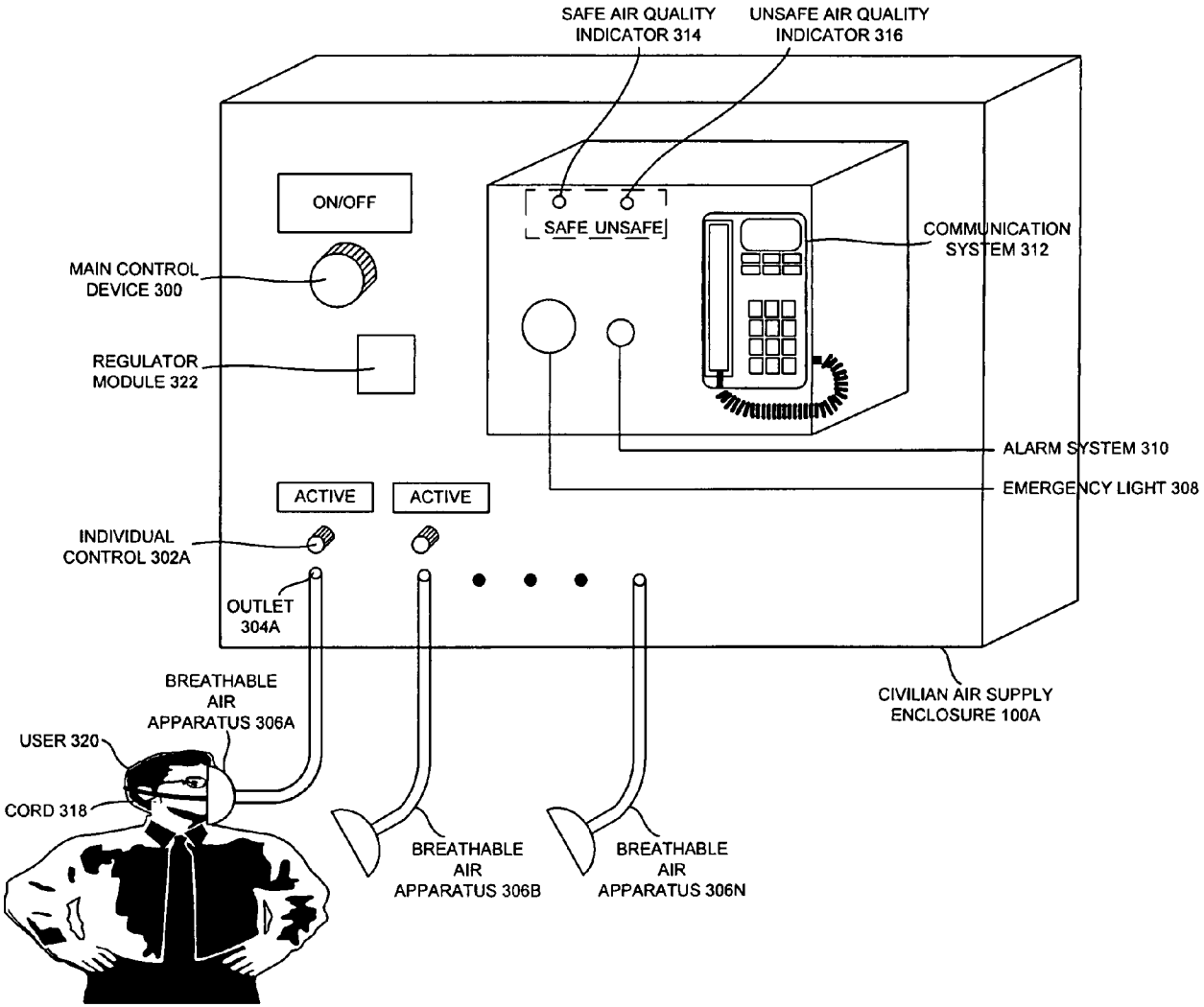
FIG. 3 is a front view of a civilian air supply enclosure of FIG. 1, according to one embodiment.

FIG. 3 is a front view of a civilian air supply enclosure of FIG. 1, according to one embodiment. Particularly, FIG. 3 illustrates the civilian air supply enclosure 100A, a main control device 300, individual controls 302A-N, outlets 304A-N, breathable air apparatuses 306A-N, an emergency light 308, an alarm system 310, a communication system 312, an air safe quality indicator 314, an unsafe air quality indicator 316, a cord 318, a user 320, and a regulation module 322, according to one embodiment.

The main control device 300 may be a control device that may enable or disable a civilian air supply enclosure 100A. The individual controls 302A-N may be a switch that may enable a user to control the flow of air coming out from the outlets 304A-N of each of the breathable air apparatuses 306A-N of the civilian air supply enclosure 100A. The outlets 304A-N may be the outlets from the civilian air supply enclosure 100A that may provide breathable air to the users through the breathable air apparatuses 306A-N. Each of the breathable air apparatuses 306A-N may be an apparatus (e.g., a respiratory mask, a face covering, a protective breathing unit, etc.) that may enable the user 350 to consume the breathable air.

The emergency light 308 may glow to indicate emergency situations. The alarm system 310 may provide an alert to the emergency personnel, civilians, etc. to indicate possible danger and for cover (e.g., getting into safety zone, etc.). The communication system 312 may enable anybody to communicate with the emergency personnel, police, etc. during emergency when the emergency light 308 turns on. The air safe quality indicator 314 may indicate that the quality of the breathable air in the air distribution system 150 is safe for human consumption.

The unsafe air quality indicator 316 may indicate that the quality of the air in the air distribution system 116 is unsafe for human consumption. The cord 318 may enable the user to adjust the breathable air apparatus 306A-N for consuming the breathable air. The user 320 may be a civilian, a firefighter, etc. who may use the fill panels for breathable air during emergency. The regulation module 322 may regulate the air, and/or manage the systems, etc.

In an example embodiment, the civilian air supply enclosure 100A may include the breathable air apparatuses 306A-N, which may be coupled to the fill panel and/or may deliver breathable air during an emergency from the set of the breathable air apparatuses 306A-N. The communication system 312, the alarm system 310, the emergency light 308 may indicate and communicate the emergency situation to the emergency personnel.

In one embodiment, the civilian breathable air apparatus (e.g., the breathable air apparatuses 306A-N of FIG. 3) may be a respiratory mask, a face covering, and/or a protective breathing unit. The firefighter breathable air apparatus may be a portable compressed air container that facilitates delivery of the breathable air to the firefighter during a rescue mission. The communication system 312 of the civilian air supply enclosures 100A-B may enable communication with emergency personnel directly from the civilian air supply enclosures 100A-B.

The alarm may be triggered (e.g., may be by using the alarm system 310 of FIG. 3) when the breakable cover 702 of the civilian air supply enclosures 100A-B may be compromised that alerts an emergency personnel to a location in the structure (e.g., may be building structure, etc.) where rescue aid may be required. The regulation module 322 of the civilian air supply enclosures 100A-B and/or the firefighter air supply enclosures 102A-B may maintain pressures of the breathable air when other breathable air apparatuses may be actively being used to deliver the breathable air through the fill panel (e.g., the civilian air supply enclosure, the firefighter air supply enclosure, etc.).

A communication mechanism between the civilian air supply enclosures 100A-B and the emergency personnel may be provided (e.g., using the communication system 312 of FIG. 3) through a telephone affixed to the fill panel (e.g., the civilian air supply enclosure, the firefighter air supply enclosure, etc.). The civilian air supply enclosures 100A-B may provide a civilian-pressure of the breathable air such that pressures may be suitable for direct human consumption through the civilian breathable air apparatus 306A-N coupled with the fill panel (e.g., the civilian air supply enclosure, the firefighter air supply enclosure, etc.).

The civilian pressure of the breathable air may be approximately 10 to 40 Pounds per Square Inch (PSI) for the civilian breathable air apparatus 306A-N such that civilian pressure may be suitable for direct human consumption through the civilian breathable air apparatus 306A-N. The civilian breathable air apparatus 306A-N may be a respiratory mask, a face covering (e.g., elastic face covering), and/or a protective breathing unit.

Figure 4:
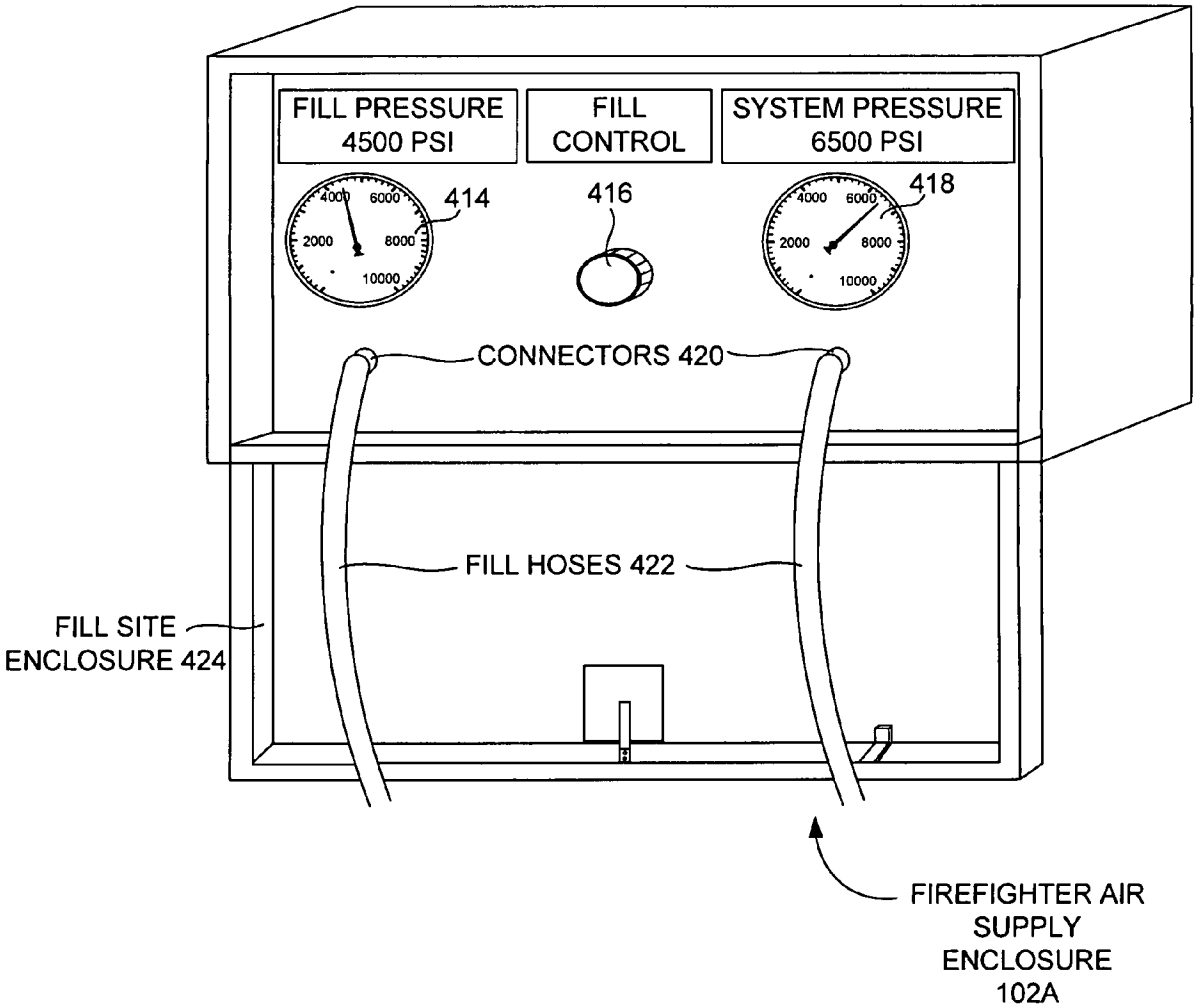
FIG. 4 illustrates a firefighter air supply enclosure including pressure indicators, fill control knob, etc. according to one embodiment.

FIG. 4 illustrates a firefighter air supply enclosure 102A including pressure indicators, fill control knob, etc., according to one embodiment. Particularly, FIG. 4 illustrates fill panel pressure indicator 414, fill control 416, system pressure indicator 418, connectors 420, fill hoses 422, and a fill site enclosure 424, according to one embodiment.

The fill panel pressure indicator 414 may indicate pressure in the fill panels. The fill control 416 may enable the user of the control panel to control the pressure in the fill panels. The system pressure indicator 418 may indicate the pressure in the distribution system and storage subsystem. The connectors 420 may provide connection from the firefighter air supply enclosure 102A to the firefighter breathable air apparatus. The fill hoses 422 may provide connection with the respiratory mask. The fill site enclosure 424 may be covering or enclosure to the fill panel.

In example embodiment, FIG. 4 illustrates firefighter air supply enclosure 102A that may have indicators that may show pressures in fill panel and distribution system. The control may also have a fill control knob that may enable the users (e.g., the firefighters) to control the fill panel pressure. The connectors may provide opening that allows fill hoses 422 to route the breathable air.

In one embodiment, the firefighter air supply enclosures 102A-B may provide a high-pressure of the breathable air such that pressures may be suitable for filling the breathable air in a firefighter breathable air apparatus through RIC/UAC/CGA connectors 1320 on the fill panel (e.g., the civilian air supply enclosure, the firefighter air supply enclosure, etc.). The regulation module 322 may be installed the civilian air supply enclosures 100A-B, the firefighter air supply enclosures 102A-B, and/or the air distribution system 116 to facilitate delivering of the breathable air of approximately 10 to 40 Pounds per Square Inch (PSI) for the civilian air supply enclosures 100A-B to facilitate delivering of the breathable air of approximately 3000-6000 Pounds per Square Inch (PSI) for the firefighter air supply enclosures 102A-B. The firefighter breathable air apparatus may be a portable compressed air container that facilitates delivering of the breathable air to the firefighter during a rescue mission.

Figure 5:
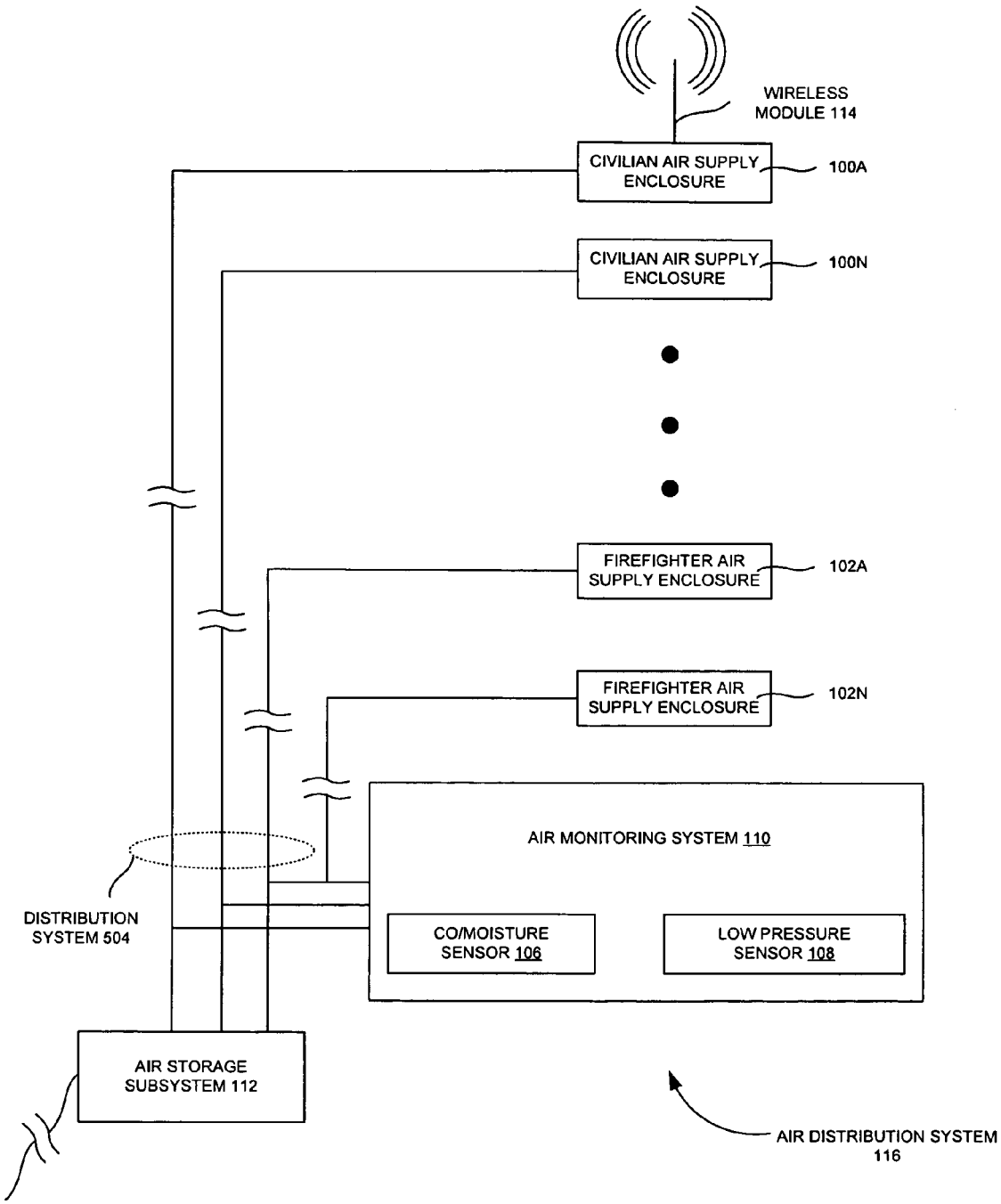
FIG. 5 is a systematic view of an air distribution system, according to one embodiment.

FIG. 5 is a systematic view of an air distribution system, according to one embodiment. Particularly, FIG. 5 illustrates the civilian air supply enclosures 100A-N, the firefighter air supply enclosures 102A-N, the CO/moisture sensor 106, the low pressure sensor 108, the air monitoring system 110, the air storage subsystem 112, the wireless module 114, and the air distribution system 116, and the distribution system 504, according to one embodiment.

The distribution system 504 may be the method of air distribution from the air storage subsystem 112 to the civilian air supply enclosures 100A-N where the air may be monitored by the air monitoring system 110.

In an example embodiment, FIG. 5 illustrates the air distribution system 116 that may include a number of civilian air supply enclosures (e.g., the civilian air supply enclosures 100A-N) connected to the air storage subsystem 112 through the distribution system 404. The air distribution system 450 may include an air monitoring system 110 having the CO/Moisture sensor 106 and/or the low pressure sensor 108 to detect presence of the CO/moisture in the air storage subsystem 112.

Figure 6:
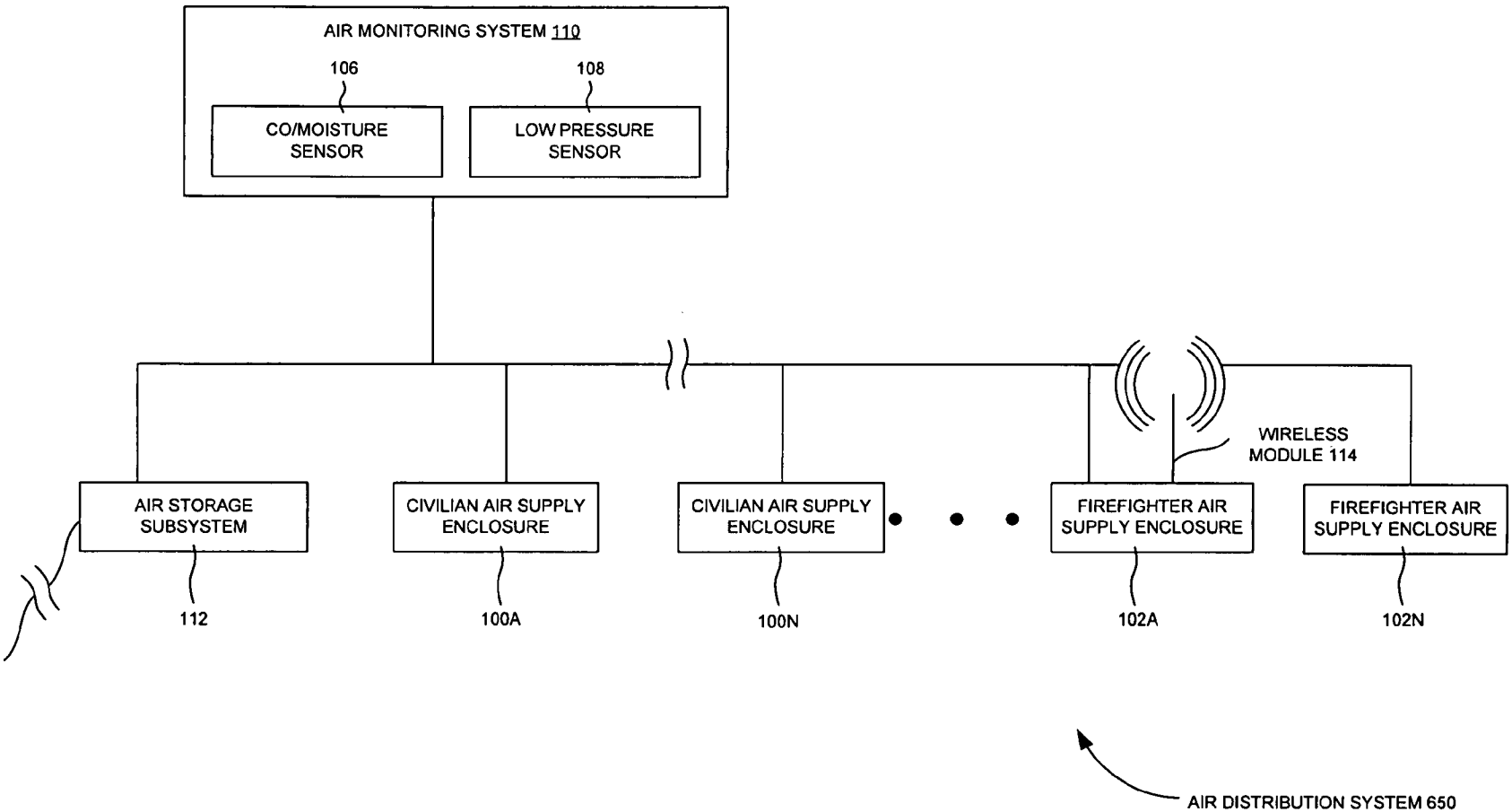
FIG. 6 is a systematic view of the air distribution system having fill panels in a building structure, according to one embodiment.

FIG. 6 is a systematic view of the air distribution system having fill panels in a building structure, according to one embodiment. Particularly, FIG. 6 illustrates the civilian air supply enclosures 100A-N, the firefighter air supply enclosures 102A-N, the CO/moisture sensor 106, the low pressure sensor 108, the air monitoring system 110, and the air storage subsystem 112, according to one embodiment.

In an example embodiment, the air distribution system 650 may include air storage subsystem 112, the civilian air supply enclosures 100A-N and the firefighter air supply enclosures 102A-N that may be coupled to the rest of the air distribution system 150 through a distribution system 404. The air distribution system 650 may also include the air monitoring system 110 having the CO/Moisture sensor 106 and the low pressure sensor 108. Each air distribution system (e.g., the air distribution system 650) may be used in conjunction with one another depending on the particular architectural style of the building structure in a manner that provides most efficient access to the breathable air of the air distribution system 650 reliably.

Figure 7:
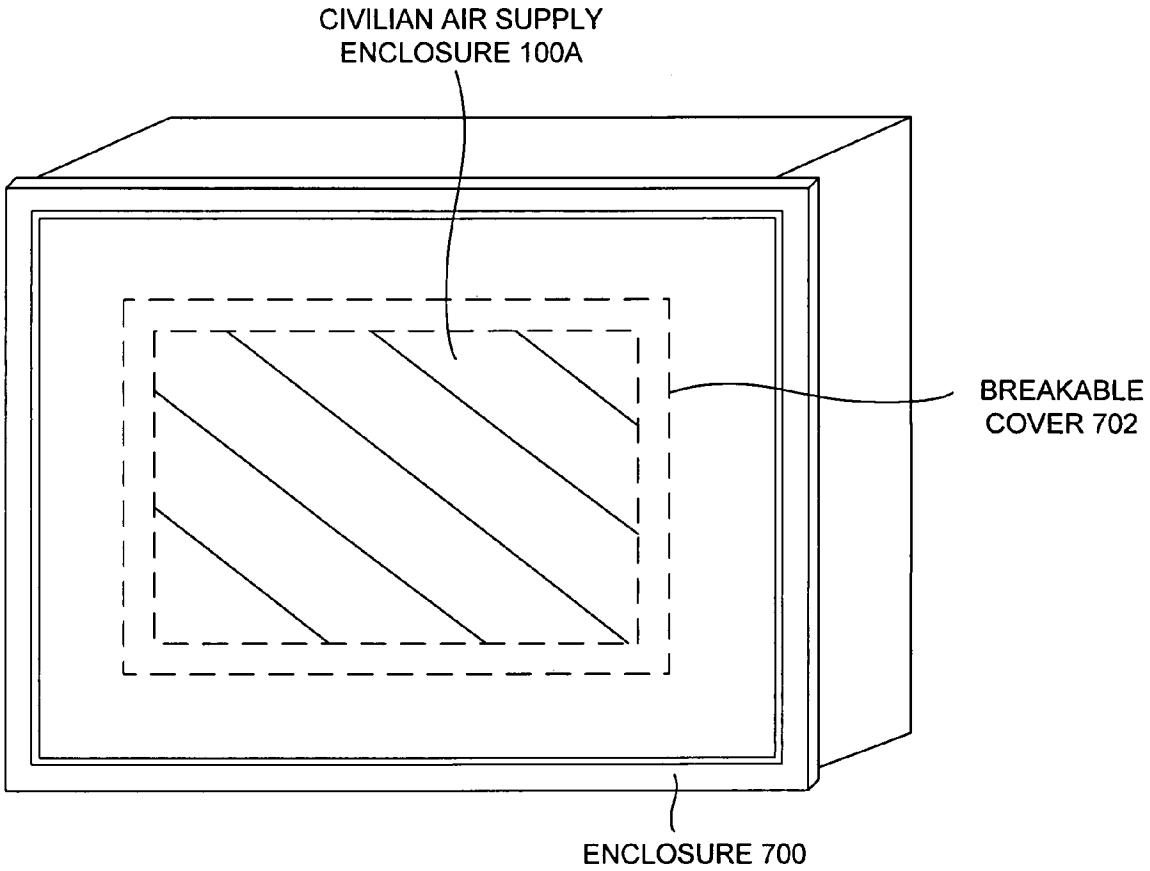
FIG. 7 is a systematic view of an enclosure of an emergency alerting system, according to one embodiment.

FIG. 7 is a systematic view of an enclosure of an emergency alerting system, according to one embodiment. Particularly, FIG. 7 illustrates the civilian air supply enclosure 100A, an enclosure 700, and breakable cover 702, according to one embodiment.

The enclosure 700 may be a covering structure provided to protect the civilian air supply enclosure 100A. The breakable cover 702 may be a cover that may be easily broken at the required emergency time (e.g., glass covering, etc.).

In example embodiment, FIG. 7 illustrates the enclosure that may include the civilian air supply enclosure 100A which may be covered by the breakable cover 702 such that during the emergency time the user 350 may break the cover and may gain access to the civilian air supply enclosure 100A.

In one embodiment, the breakable cover 702 of an enclosure of the civilian air supply enclosures 100A-B may secure the civilian air supply enclosures 100A-B from intrusions that potentially compromise safety and/or reliability of the air distribution system 116. The enclosure 700 encompassing the civilian air supply enclosures 100A-B and/or the firefighter air supply enclosures 102A-B may have a weather resistant feature, ultraviolet and/or infrared solar radiation resistant feature to prevent corrosion and/or physical damage. It may be determined that the breakable cover 702 of the civilian air supply enclosures 100A-B may be compromised. A signal that provides a notification of a location of the civilian air supply enclosures 100A-B may be transmitted to emergency personnel.

Figure 8:
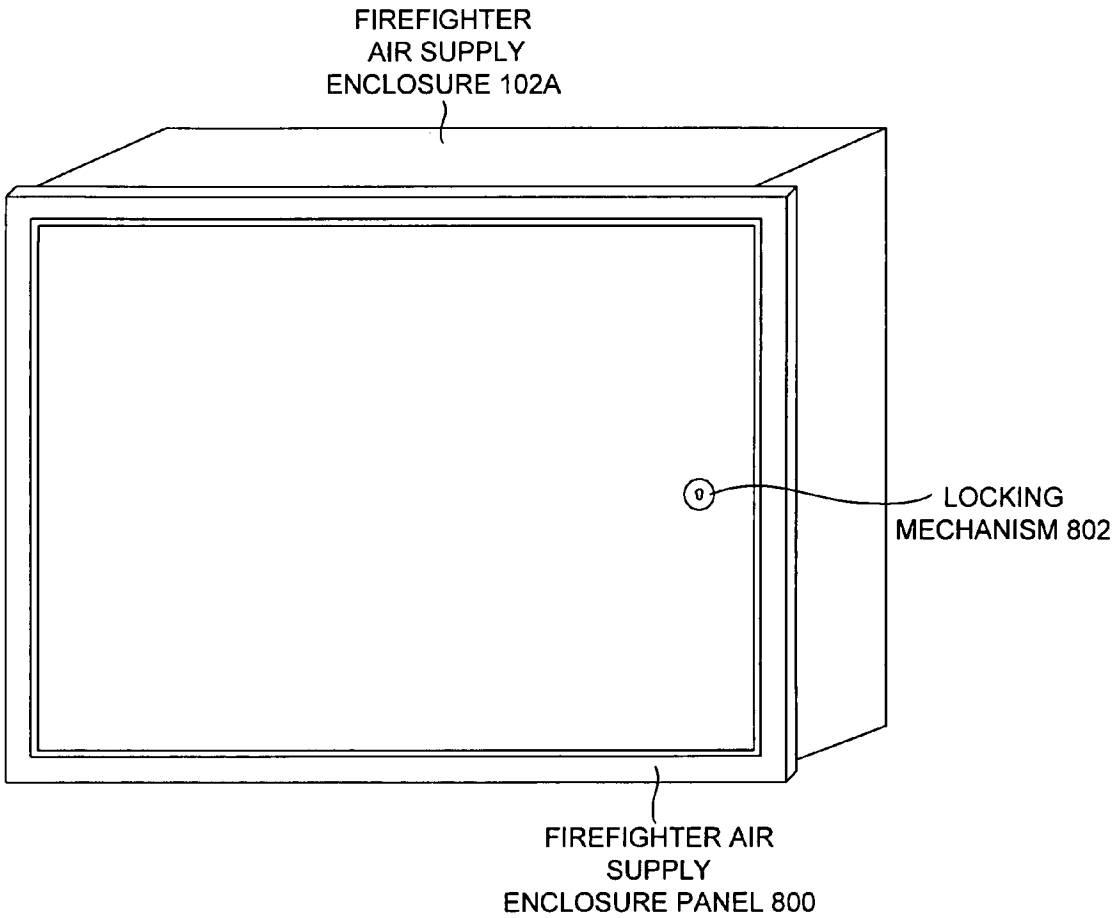
FIG. 8 is a systematic view of a closed enclosure of an emergency alerting system, according to one embodiment.

FIG. 8 is a systematic view of a closed enclosure of an emergency alerting system, according to one embodiment. Particularly, FIG. 8 illustrates the firefighter air supply enclosure 102A, a firefighter air supply enclosure panel 800, and locking mechanism 802, according to one embodiment.

The firefighter air supply enclosure panel 800 may be protective covering for the firefighter air supply enclosure 102A to protect from unauthorized access. The locking mechanism 802 may be locking system (e.g., may be using lock and keys, computerized locks, etc.) to protect the firefighter air supply enclosure 102A from unauthorized access.

In example embodiment, FIG. 8 illustrates the firefighter air supply enclosure 102A that has been protected using the firefighter air supply enclosure panel 800 and locking mechanism attached to the firefighter air supply enclosure panel 800.

In one embodiment, a solid cover with the locking mechanism 802 of the firefighter air supply enclosures 102A-B may secure the firefighter air supply enclosures 102A-B from intrusions that potentially compromise safety and reliability of the air distribution system 116.

Figure 9B:
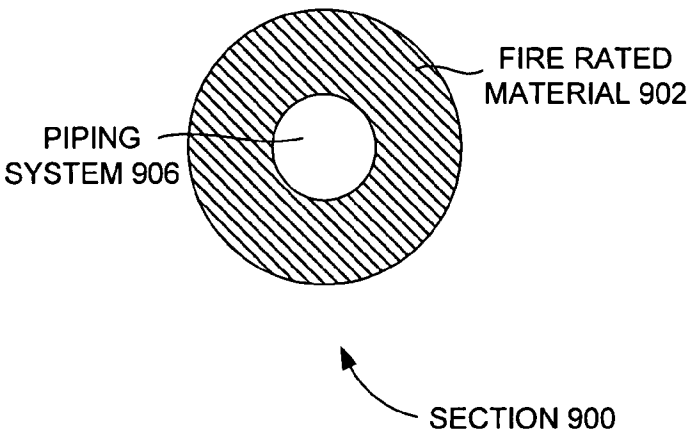
FIG. 9A and FIG. 9B is a diagrammatic view and a cross sectional view of a piping system respectively in a fire rated material, according to one embodiment.
Figure 9A:
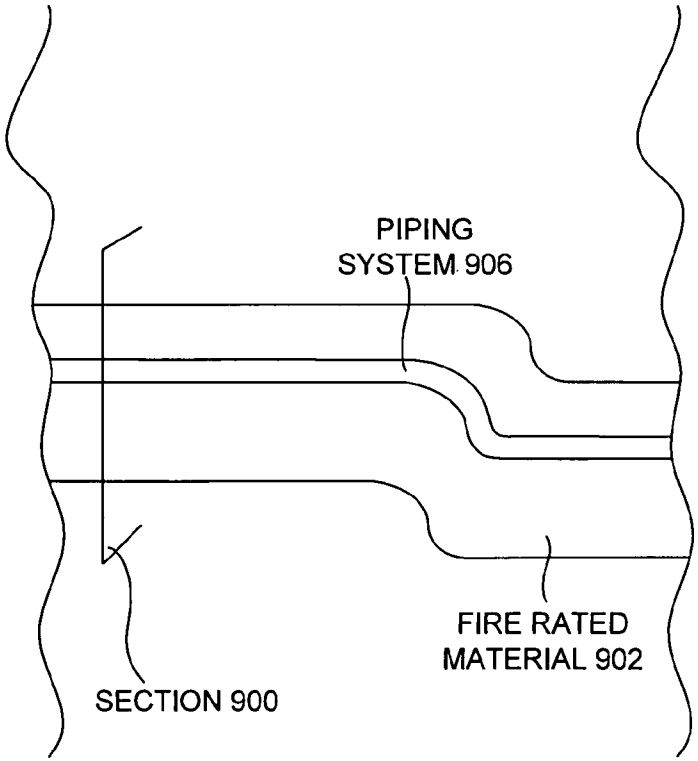

FIG. 9A and FIG. 9B is a diagrammatic view and a cross sectional view of a piping system respectively in a fire rated material, according to one embodiment. Particularly, FIG. 9A-B illustrates a section 900, a fire rated material 902, and a piping 906, according to one embodiment.

The section 900 may illustrate the section of the piping 906. The fire rated material 902 may enclose the piping 906. The fire rated material may be certified to withstand elevated temperature for a period of time. The piping 906 may be made out of any of a stainless steel, a thermoplastic material, etc. that may be compatible for use with compressed air.

In example embodiment, FIG. 9A and FIG. 9B may illustrate a piping system where the piping 906 may be covered and/or protected by the fire rated material 902.

Figure 10:
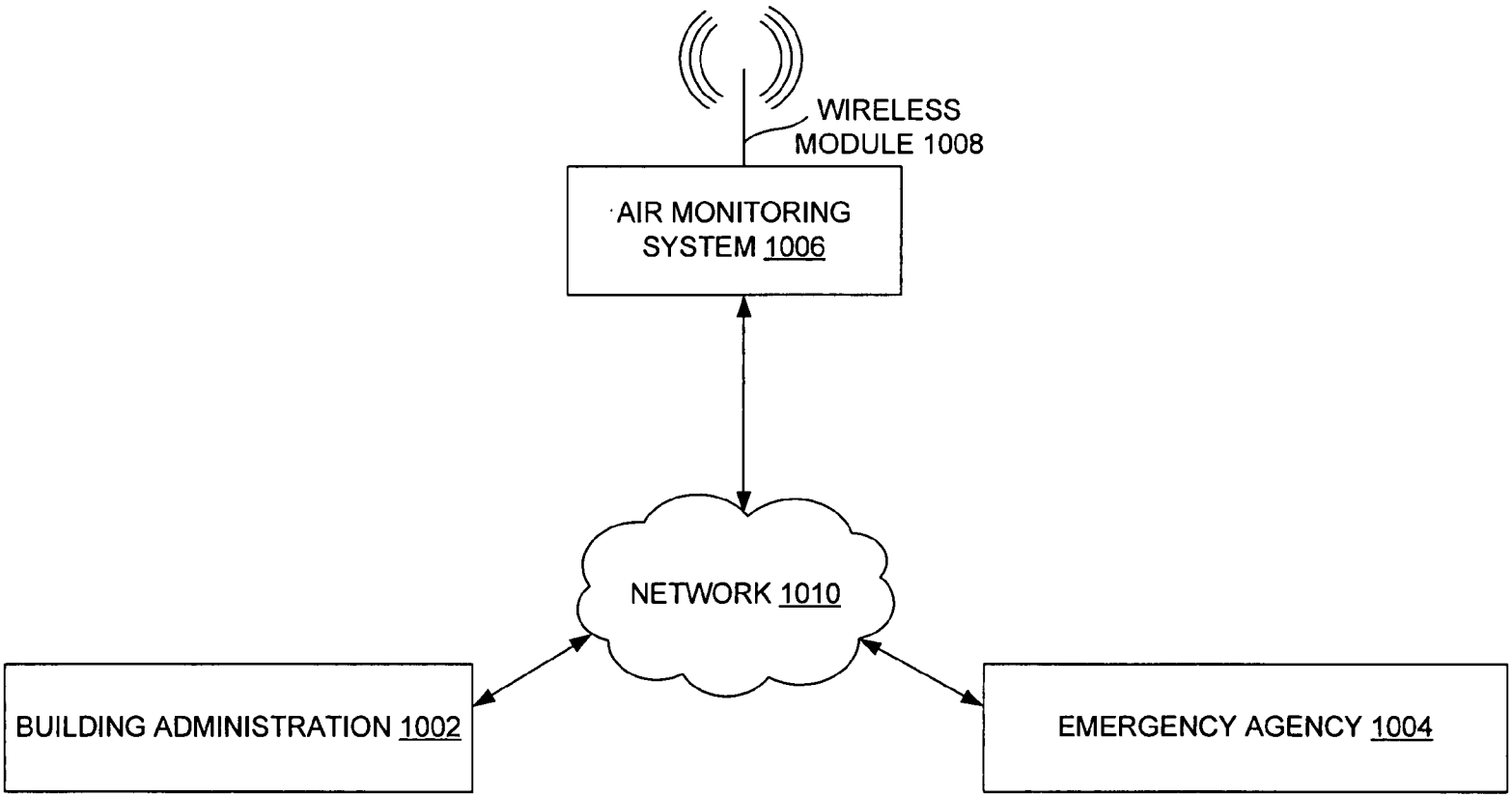
FIG. 10 is a systematic view showing a communication between a building administration, an emergency agency and/or an air monitoring system through a network, according to one embodiment.

FIG. 10 is a systematic view showing a communication between a building administration, an emergency agency and/or an air monitoring system through a network, according to one embodiment. Particularly, FIG. 10 illustrates a building administration 1002, an emergency agency 1004, an air monitoring system 1006, a wireless module 1008, and a network 1010, according to one embodiment.

The building administration 1002 may be an administrative department of the building that may be informed when an emergency occurs. The emergency agency 1004 may be an expert in handling emergency situations by providing various kinds of services (e.g., life rescue, medical help, etc.). The air monitoring system 1006 may monitor the system to ensure the safe condition of the breathable air in the building.

The wireless module 1008 may be a communication system that may inform the building administration 1002, the emergency agency, etc. when an emergency situation occurs. The network 1010 may be a LAN, a WAN, or an internet network that may enable communication between the building administration 1002, the emergency agency 1004, the air monitoring system 1006, etc.

In example embodiment, FIG. 10 may illustrate the communication between the building administration 1002, the emergency agency 1004, and/or the air monitoring system 1006 through the network 1010. The wireless module 1008 may communicate with the building administration 1002 and/or the emergency agency 1004 when an emergency situation (e.g., degradation of breathable air, pressure change in the breathable air, etc.) occurs.

Figure 11:
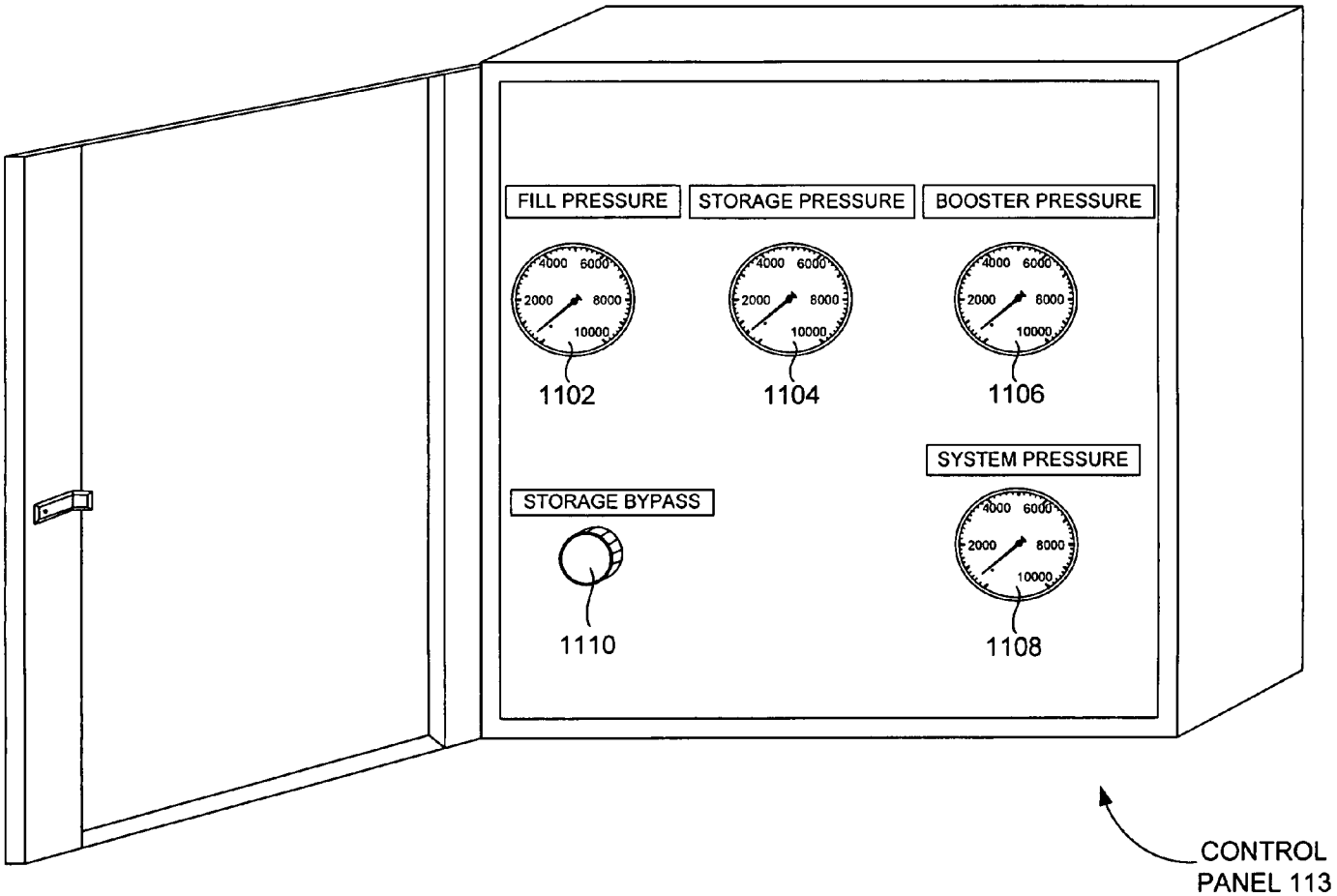
FIG. 11 is a systematic view of a control panel of an air storage sub-system, according to one embodiment.

FIG. 11 is a systematic view of a control panel of an air storage sub-system, according to one embodiment. Particularly, FIG. 11 illustrates a fill pressure indicator 1102, a storage pressure indicator 1104, a booster pressure indicator 1106, a system pressure indicator 1108, a storage bypass 1110, and a control panel 113, according to one embodiment.

The fill pressure indicator 1102 may indicate the pressure level at which the breathable air is being delivered by the source of compressed air to the air distribution system. The storage pressure indicator 1104 may display the pressure level of air storage tanks in the air storage subsystem 112. The booster pressure indicator 1106 may display the pressure level of the booster tank 1206. The system pressure indicator 1108 may indicate the current pressure level of the breathable air in the air distribution system. The storage bypass 1110 may directly supply the air to the air distribution system.

In an example embodiment, the control panel 120 may include the fill pressure indicator 1102, the storage pressure indicator 1104, the booster pressure indicator 1106, the system pressure indicator 1108 and/or the storage bypass 1110. The air distribution system 116 can be controlled from this control panel 113 by keeping a check/monitoring the pressures by observing the pressure indicators.

Figure 12:
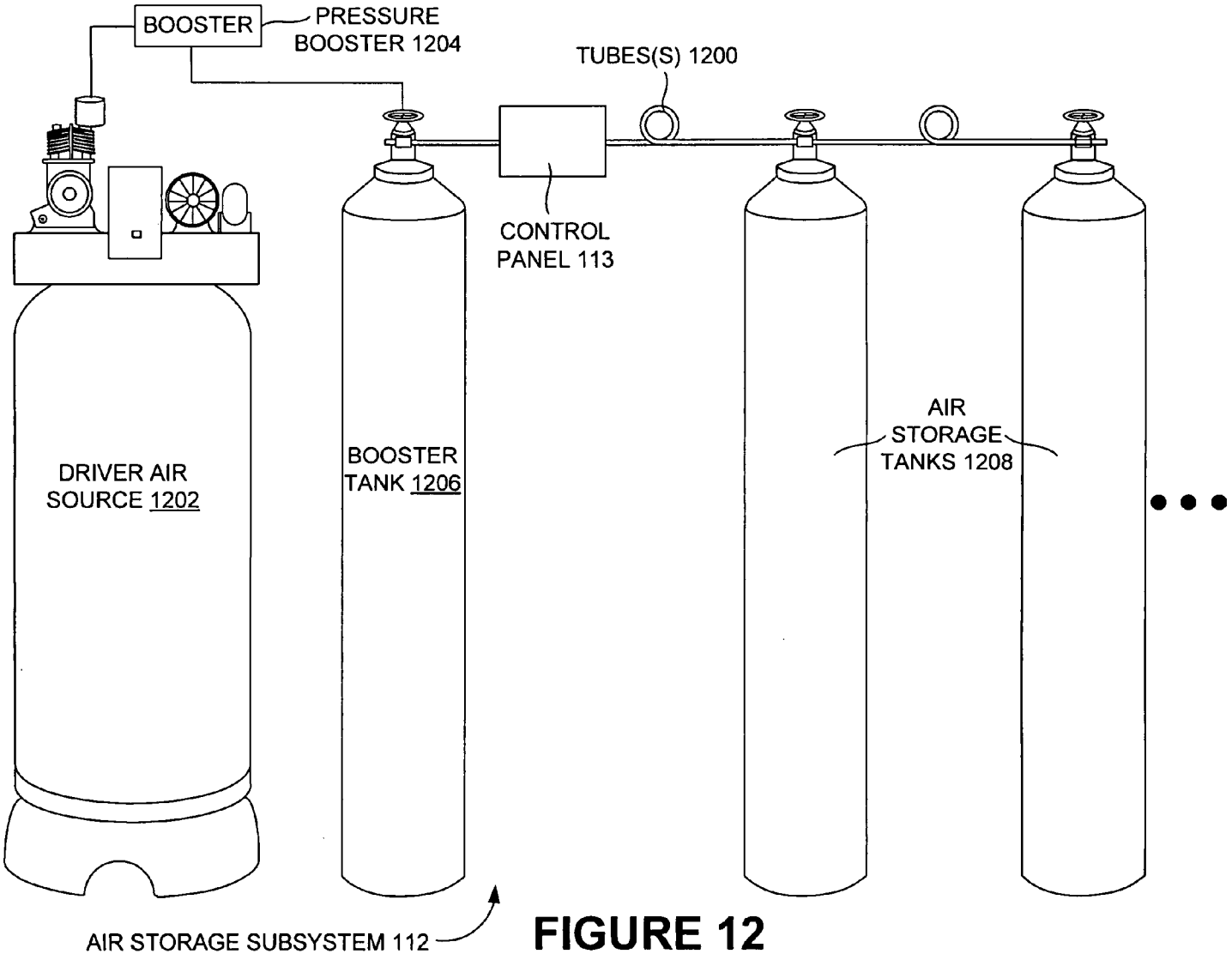
FIG. 12 is a systematic view of an air storage subsystem, according to one embodiment.

FIG. 12 is a systematic view of an air storage subsystem, according to one embodiment. Particularly, FIG. 12 illustrates tube(s) 1200, a driver air source 1202, a pressure booster 1204, a booster tank 1206, air storage tanks 1208, and the control panel 120, according to one embodiment.

The control panel 113 may provide status information regarding the various components of the air storage subsystem 112. The tubes 1200 may couple each of the air storage tanks 1208 to one another in a looped configuration to increase robustness of the tubes 1200. The driver air source 1202 may be used to pneumatically drive the pressure booster 1204. The pressure booster 1204 may maintain a pressure of the air distribution system 116 such that the pressure is suitable for a direct human consumption.

The booster tank 1206 may store air at a higher pressure than the air stored in the air storage tanks 1208 to ensure that the air distribution system 116 have enough supply of the breathable air in case of an emergency. The air storage tanks 1208 may store the air that may be consumed through the breathable air apparatuses.

In an example embodiment, the air storage subsystem 112 may include the control panel 120, the tubes 1200, the driver air source 1202, the pressure booster 1204, the booster tank 1206, and/or any number of the air storage tanks 1208. The air storage tanks 1208 and/or the booster tank 1206 of the air storage subsystem 112 may be supplied with breathable air through a source of compressed air that may be coupled to the air distribution system 116 through the supply unit 104. The air storage subsystem 112 may provide a spare source of breathable air to the air distribution system in addition to the source of compressed air.

Figure 13:
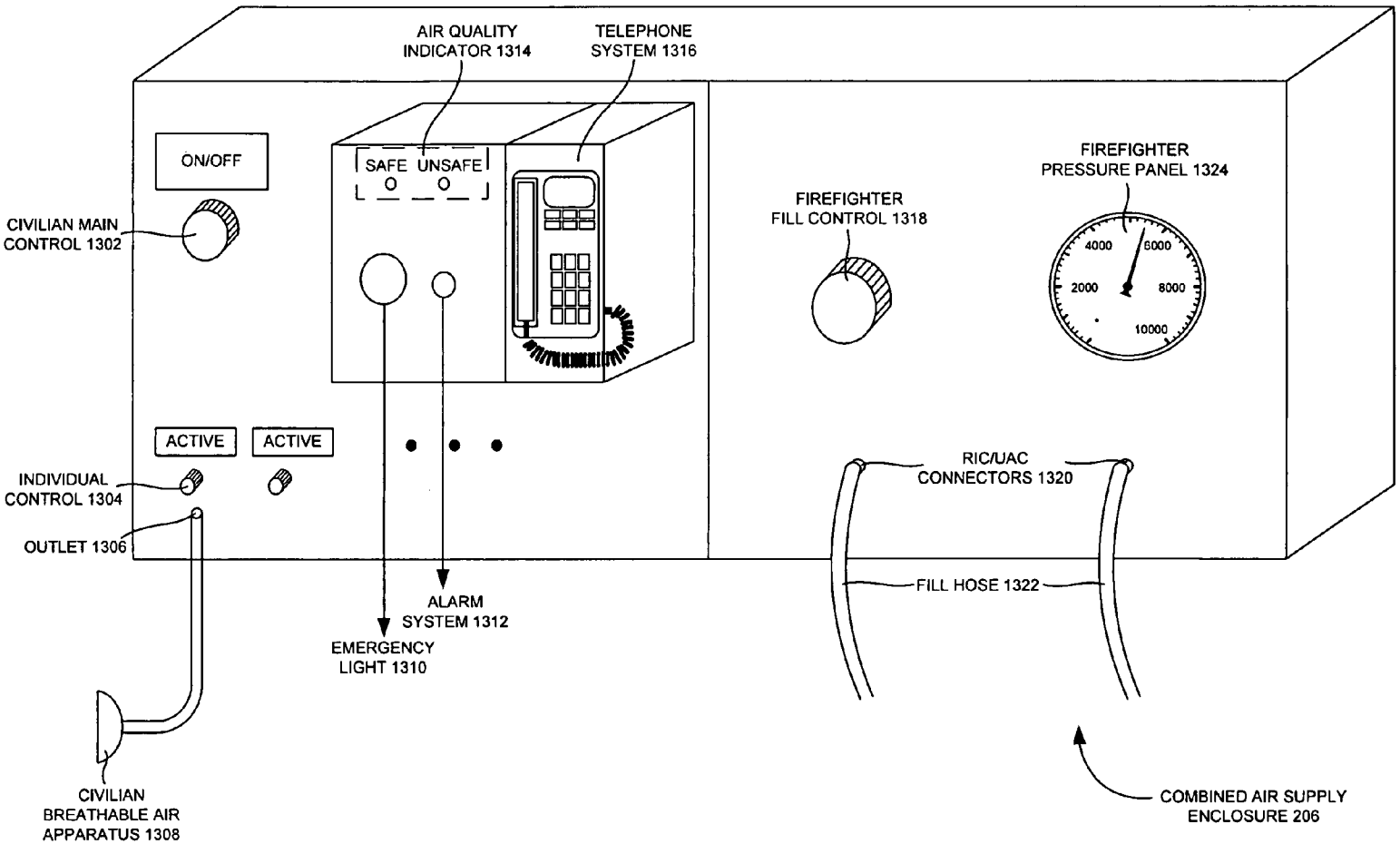
FIG. 13 is a systematic view of a fill panel combined with a control panel, according to one embodiment.

FIG. 13 is a systematic view of a fill panel combined with a control panel, according to one embodiment. Particularly, FIG. 13 illustrates a civilian main control 1302, an individual control 1304, an outlet 1306, a civilian breathable air apparatus 1308, an emergency light 1310, an alarm system 1312, an air quality indicator 1314, a telephone system 1316, a firefighter control 1318, RIC/UAC/CGA connectors 1320, fill hose 1322, and a firefighter pressure panel 1324, according to one embodiment.

The civilian main control 1302 may control the flow of the breathable air in the civilian panels. The individual control 1304 may be controls that may be enable the users to adjust pressure for their consumption. The outlet 1306 may be an outlet that may enable connection for breathable air apparatus. The civilian breathable air apparatus 1308 may be an apparatus that may enable the user to breath good air during emergency (e.g., during moments of fire, etc. when there is a lack of breathable air in environment). The emergency light 1310 may indicate emergency (e.g., contamination of air, fire in building, etc.).

The alarm system 1312 may be a switch that may enable the user to send an alarm to the building, rescue personnel, etc. The air quality indicator 1314 may indicate whether the quality of air is good or bad in a form of light indication. The telephone system 1316 may enable the user to communicate with the administrative department, emergency personnel, etc. to indicate/provide the nature of emergency. The firefighter control 1318 may enable the firefighter to control the pressure of breathable air. The RIC/UAC/CGA connectors 1320 may be a type of connectors that may enable the connection between the fill panels and fill hose 1322. The fill hose 1322 may be a hollow tube that may facilitate the flow of air from fill panels to the firefighter breathable air apparatuses. The firefighter pressure panel 1324 may be an indicator that may indicate the current pressure of the breathable air in the fill panel.

In example embodiment, FIG. 13 illustrates a combined fill panel 206 that may be a combination of the civilian air supply enclosures, the firefighter air supply enclosure along with their control panels. The user (e.g., civilian, firefighter, etc.) may use the combined fill panel during emergency. There are switches/knobs, etc. that may enable the users to communicate emergencies, nature of emergencies, control pressure of the breathable air, etc.

In one embodiment, the high-pressure of the breathable air may be approximately 3000-6000 Pounds per Square Inch (PSI) for a firefighter breathable air apparatus such that the high-pressure may be suitable for filling the compressed form of breathable air in a firefighter breathable air apparatus through the RIC/UAC/CGA connectors 1320.

Figure 14:
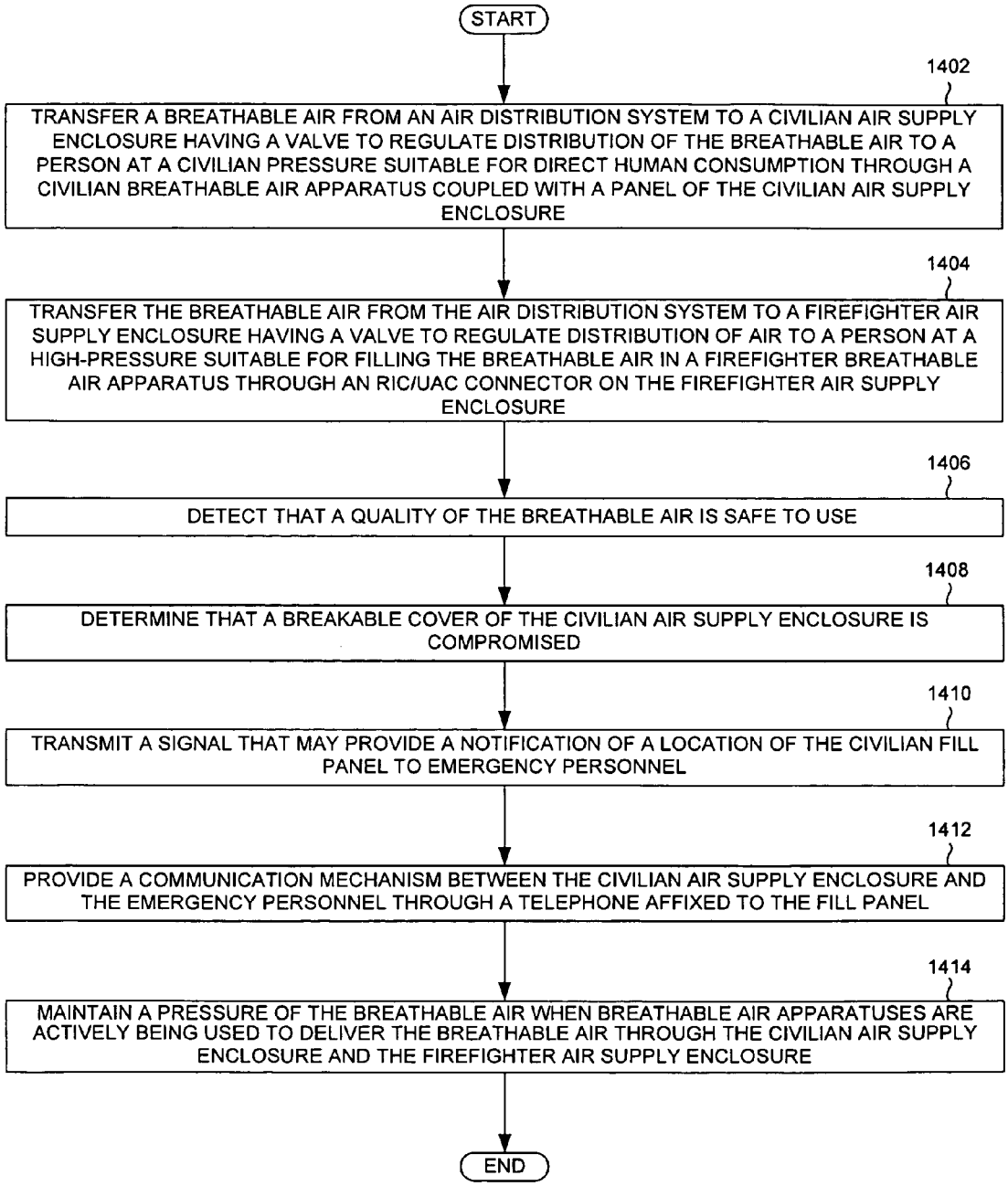
FIG. 14 is a process flow of transferring a breathable air from an air distribution system to a civilian air supply enclosure and/or a firefighter air supply enclosure, according to one embodiment.

FIG. 14 is a process flow of transferring a breathable air from an air distribution system to a civilian air supply enclosure and/or a firefighter air supply enclosure, according to one embodiment. In operation 1402, a breathable air may be transferred from an air distribution system (e.g., the air distribution system 116 of FIG. 1) to a civilian air supply enclosure (e.g., the civilian air supply enclosures 100A-B of FIG. 1) having a valve to regulate (e.g., using the regulation module 322 of FIG. 3) distribution of air to a person at a civilian pressure suitable for direct human consumption through a civilian breathable air apparatus (e.g., the civilian breathable air apparatus 306A-N of FIG. 3) coupled with the civilian air supply enclosures 100A-B.

In operation 1404, the breathable air may be transferred from the air distribution system 116 to a firefighter air supply enclosure (e.g., the firefighter air supply enclosures 102A-B of FIG. 1) having a valve to regulate distribution of air to a person at a high-pressure suitable for filling the breathable air in a firefighter breathable air apparatus through an RIC/UAC/CGA connector on the firefighter air supply enclosures 102A-B. In operation 1406, it may be detected that a quality of the breathable air may be safe to use. In operation 1408, it may be determined that a breakable cover of the civilian air supply enclosures 100A-B may be compromised. In operation 1410, a signal that provides a notification of a location of the civilian air supply enclosures 100A-B may be transmitted to emergency personnel.

The civilian pressure of the breathable air provided by the civilian air supply enclosures 100A-B may be approximately 10 to 40 Pounds per Square Inch (PSI). The high-pressure of the breathable air provided by the firefighter air supply enclosures 102A-B may be approximately 3000-6000 Pounds per Square Inch (PSI). The civilian breathable air apparatus 306A-N may be a respiratory mask, a face covering, and/or a protective breathing unit. The firefighter breathable air apparatus may be a portable compressed air container that facilitates delivering of the breathable air to the firefighter during a rescue mission.

In operation 1412, a communication mechanism between the civilian air supply enclosures 100A-B and the emergency personnel may be provided through a telephone affixed to the fill panel (e.g., the civilian air supply enclosure, the firefighter air supply enclosure, etc.). In operation 1414, a pressure of the breathable air when breathable air apparatuses may be actively being used to deliver the breathable air may be maintained through the civilian air supply enclosures 100A-B and the firefighter air supply enclosures 102A-B.

Although the present embodiments have been described with references to specific example embodiments, it will be evident that various modifications and changes may be made to these embodiments without departing from the broader spirit and scope of the various embodiments. For example, the various devices, modules, analyzers, generators, etc. described herein may be enabled and operated using hardware circuitry (e.g., CMOS based logic circuitry), firmware, software and/or any combination of hardware, firmware, and/or software (e.g., embodied in a machine readable medium).

For example, the wireless module 114, the regulation module 322 and various modules of FIGS. 1-12 may be enabled by using a wireless circuit, a regulation circuit and various circuits created by one or more of the technologies described herein.

In addition, it will be appreciated that the various operations, processes, and methods disclosed herein may be embodied in a machine-readable medium and/or a machine accessible medium compatible with a data processing system (e.g., a computer system), and may be performed in any order (e.g., including using means for achieving the various operations). Accordingly, the specification and drawings are to be regarded in an illustrative rather than a restrictive sense.

What is claimed is:

1. A safety system, comprising:

a supply unit of a structure to facilitate delivery of breathable air from a source of compressed air to an air distribution system of the structure;

a routing mechanism of the structure to provide a distribution of the breathable air;

a plurality of civilian air supply enclosures, located in a corresponding plurality of rooms on either side of a hallway of the structure along a length of the structure and configured to: receive breathable air from the air distribution system based on the routing mechanism and regulate distribution of the breathable air to provide a civilian pressure of the breathable air that is suitable for direct human consumption through a civilian breathable air apparatus coupled with each civilian air supply enclosure; and a plurality of firefighter air supply enclosures, also located on either side of the hallway along the length of the structure outside the corresponding plurality of rooms and also configured to: receive breathable air from the air distribution system based on the routing mechanism and regulate distribution of the breathable air to provide a high-pressure of the breathable air that is suitable to fill the breathable air in a firefighter breathable air apparatus coupled with each firefighter air supply enclosure, the high-pressure being significantly higher than the civilian pressure, wherein the routing mechanism of the structure is configured to enable distribution of the breathable air from the air distribution system through at least one of a wall, a ceiling, and a floor between the civilian air supply enclosures and the firefighter air supply enclosures of the structure.

2. The safety system of claim 1, further comprising a combined fill panel of the structure that provides the breathable air at the civilian pressure suitable for direct human consumption concurrently with the breathable air at the high-pressure suitable for filling the breathable air in the firefighter breathable air apparatus.

3. The safety system of claim 1, wherein:

the civilian pressure of the breathable air provided by a civilian air supply enclosure is approximately 10 to 40 Pounds per Square Inch (PSI), and the high-pressure of the breathable air provided by a firefighter air supply enclosure is approximately 3000-6000 Pounds per Square Inch (PSI).

4. The safety system of claim 1, wherein:

the civilian breathable air apparatus is at least one of a respiratory mask, a face covering, and a protective breathing unit, and the firefighter breathable air apparatus is a portable compressed air container that facilitates delivery of the breathable air to a firefighter during a rescue mission.

5. The safety system of claim 4, wherein at least one of:

each civilian air supply enclosure includes an enclosure associated therewith for protection thereof, the enclosure being covered by a breakable cover configured to secure the each civilian air supply enclosure from intrusions that potentially compromise safety and reliability of the air distribution system, and each firefighter air supply enclosure includes a solid cover with a locking mechanism to secure the each firefighter air supply enclosure from intrusions that potentially compromise safety and reliability of the air distribution system.

6. The safety system of claim 5, wherein at least one of:

the each civilian air supply enclosure further comprises a communication system to enable communication with emergency personnel directly from the each civilian air supply enclosure, and the breathable air in the firefighter breathable air apparatus is filled through at least one of a RIC/UAC connector and a Compressed Gas Association (CGA) connector of a fill panel associated therewith.

7. The safety system of claim 6, wherein the each civilian air supply enclosure includes an alarm system associated therewith to trigger an alarm when the breakable cover is compromised, thereby alerting the emergency personnel to a location in the structure where rescue aid is required.

8. The safety system of claim 1, further comprising an enclosure encompassing the each civilian air supply enclosure and the each firefighter air supply enclosure having at least one of a weather resistant feature, ultraviolet and infrared solar radiation resistant feature to prevent corrosion and physical damage.

9. The safety system of claim 1, further comprising a valve to prevent leakage of the breathable air from the air distribution system.

10. The safety system of claim 1, further comprising a regulation module of the each civilian air supply enclosure and the each firefighter air supply enclosure to maintain pressures of the breathable air when other breathable air apparatuses are actively being used to deliver the breathable air therethrough.

11. The safety system of claim 1, further comprising at least one of a fire rated material and a fire rated assembly to enclose a piping of the air distribution system such that the air distribution system possesses an ability to withstand elevated temperatures for a prescribed period of time.

12. The safety system of claim 11, further comprising:

a solid casing to encase the piping to prevent physical damage to the air distribution system; and one of a stainless steel and a thermoplastic material to ensure that the piping is compatible for use with the compressed air.

13. A method of a safety system in a structure, comprising:

transferring breathable air from an air distribution system to a plurality of civilian air supply enclosures located in a corresponding plurality of rooms on either side of a hallway of the structure along a length of the structure;

regulating, through a valve of each civilian air supply enclosure, distribution of the breathable air to a person at a civilian pressure suitable for direct human consumption through a civilian breathable air apparatus coupled with a panel of the each civilian air supply enclosure;

transferring breathable air from the air distribution system to a plurality of firefighter air supply enclosures also located on either side of the hallway along the length of the structure outside the corresponding plurality of rooms;

regulating, through a valve of each firefighter air supply enclosure, distribution of the breathable air to a person at a high-pressure suitable for filling the breathable air in a firefighter breathable air apparatus through a connector on the each firefighter air supply enclosure, the high-pressure being significantly higher than the civilian pressure;

distributing the breathable air from the air distribution system through at least one of a wall, a ceiling, and a floor between the civilian air supply enclosures and the firefighter air supply enclosures of the structure; and detecting that a quality of the breathable air is safe to use.

14. The method of claim 13, wherein:

the civilian pressure of the breathable air provided by the each civilian air supply enclosure is approximately 10 to 40 PSI, and the high-pressure of the breathable air provided by the each firefighter air supply enclosure is approximately 3000-6000 PSI.

15. The method of claim 13, wherein:

the civilian breathable air apparatus is at least one of a respiratory mask, a face covering, and a protective breathing unit, and the firefighter breathable air apparatus is a portable compressed air container that facilitates delivering of the breathable air to a firefighter during a rescue mission.

16. The method of claim 13, further comprising at least one of:

determining that a breakable cover of the each civilian air supply enclosure is compromised;

transmitting a signal that provides a notification of a location of the each civilian air supply enclosure to emergency personnel;

providing a communication mechanism between the each civilian air supply enclosure and the emergency personnel through a telephone affixed to the fill panel; and maintaining a pressure of the breathable air when breathable air apparatuses are actively being used to deliver the breathable air through the civilian air supply enclosures and the firefighter air supply enclosures.

17. A structure comprising:

a plurality of civilian air supply enclosures, located in a corresponding plurality of rooms on either side of a hallway of the structure along a length of the structure, configured to receive breathable air from an air distribution system and to provide a civilian pressure of the breathable air such that the civilian pressure is suitable for direct human consumption through a civilian breathable air apparatus coupled with each civilian air supply enclosure;

a plurality of firefighter air supply enclosures, also located on either side of the hallway along the length of the structure outside the corresponding plurality of rooms, and also configured to receive breathable air from the air distribution system and to provide a high-pressure of the breathable air such that the high pressure is suitable for filling the breathable air in a firefighter breathable air apparatus coupled with each firefighter air supply enclosure through a connector on a fill panel associated therewith, the high-pressure being significantly higher than the civilian pressure; and a regulation module to maintain an appropriate pressure of the breathable air of the each civilian air supply enclosure and the each firefighter air supply enclosure during an active use thereof, wherein a routing mechanism is implemented in the structure to enable distribution of the breathable air from the air distribution system through at least one of a wall, a ceiling, and a floor between the civilian air supply enclosures and the firefighter air supply enclosures of the structure.

18. The structure of claim 17, wherein at least one of:

the regulation module is installed at at least one of the each civilian air supply enclosure and the each firefighter air supply enclosure, and the air distribution system is configured to facilitate delivering of the breathable air of approximately 10 to 40 PSI for the each civilian air supply enclosure and approximately 3000-6000 PSI for the each firefighter air supply enclosure.

19. The structure of claim 17, wherein:

the civilian breathable air apparatus is at least one of a respiratory mask, a face covering, and a protective breathing unit.

20. The structure of claim 17, wherein:

the firefighter breathable air apparatus is a portable compressed air container that facilitates delivering of the breathable air to the firefighter during a rescue mission.

* * * * *